US011052680B2

(12) United States Patent
Tokuda

(10) Patent No.: US 11,052,680 B2
(45) Date of Patent: Jul. 6, 2021

(54) PRINTING APPARATUS AND METHOD OF CONTROLLING PRINTING APPARATUS

(71) Applicant: SEIKO EPSON CORPORATION, Tokyo (JP)

(72) Inventor: Takeshi Tokuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/745,783

(22) Filed: Jan. 17, 2020

(65) Prior Publication Data

US 2020/0230979 A1 Jul. 23, 2020

(30) Foreign Application Priority Data

Jan. 21, 2019 (JP) ..... JP2019-007904

(51) Int. Cl.
*B41J 11/66* (2006.01)

(52) U.S. Cl.
CPC ..... *B41J 11/663* (2013.01)

(58) Field of Classification Search
CPC ..... B41J 11/663; B41J 11/703; B41J 29/38; B26D 2007/005; B26D 7/24; B26D 5/00; B26D 1/085
USPC ..... 347/218
See application file for complete search history.

(56) References Cited

U.S. PATENT DOCUMENTS

2003/0198499 A1* 10/2003 Tsuchiya ..... B41J 11/0045 400/621
2007/0211099 A1* 9/2007 Lyons ..... B41J 3/60 347/16
2016/0114596 A1 4/2016 Komai et al.

FOREIGN PATENT DOCUMENTS

| | | |
|---|---|---|
| JP | 2005238754 | 9/2005 |
| JP | 2010188567 | 9/2010 |
| JP | 2015051798 | 3/2015 |
| JP | 2016085446 | 5/2016 |
| JP | 2017177278 | 10/2017 |

* cited by examiner

*Primary Examiner* — Huan H Tran
*Assistant Examiner* — Alexander D Shenderov
(74) *Attorney, Agent, or Firm* — Workman Nydegger

(57) ABSTRACT

A printing apparatus including: a printing apparatus main body, a main body of a cutter unit, an attachment position thereof with respect to the printing apparatus main body being changeable, a fixed blade, a movable blade configured to mesh with the fixed blade to cut a printing medium, and a pickup sensor configured to detect a printing medium, in which the movable blade and the pickup sensor are supported on the main body, and with a change of an attachment position of the cutter support, an amount of a remaining portion of the printing medium after being cut by the movable blade changes.

7 Claims, 13 Drawing Sheets

PRINTING APPARATUS AND METHOD OF CONTROLLING PRINTING APPARATUS

The present application is based on, and claims priority from JP Application Serial Number 2019-007904, filed Jan. 21, 2019, the disclosure of which is hereby incorporated by reference herein in its entirety.

BACKGROUND

1. Technical Field

The present disclosure relates to a printing apparatus and a method of controlling the printing apparatus.

2. Related Art

Conventionally, a printing apparatus provided with a cutter is known (see, for example, JP-A-2016-85446). The printing apparatus described in JP-A-2016-85446 is a label printer for printing a label, and includes a cutter unit configured to cut a printed label. Furthermore, the printing apparatus includes a sensor configured to detect a label, and prints a next label upon determination, based on an output from the sensor, that the label has been removed.

When cutting a printed material with the cutter, the printing apparatus may deliberately leave a portion not to be cut. The portion not to be cut is commonly referred to as cutting residue. A size of the cutting residue preferably is changeable in accordance to the use. However, there is no past example of a position and a configuration for disposing a sensor configured to detect a printed material in a case where the size of the cutting residue is changeable.

SUMMARY

One aspect of solving the above problem is a printing apparatus for cutting, by a first blade and a second blade, a printing medium drawn from a roll paper. The printing apparatus includes a printing apparatus main body, a detector configured to detect the printing medium, and a cutter support configured to support the first blade and the detector. In the printing apparatus, an attachment position of the cutter support to the printing apparatus main body is changeable, and with a change of an attachment position of the cutter support, an amount of a remaining portion of the printing medium, after cut by the first blade, changes.

In the above-described configuration, the printing apparatus may include a transport unit configured to transport the printing medium, and the detector is provided downstream of the first blade in a transport direction of the printing medium.

In the above-described configuration, the printing apparatus may include a drive mechanism configured to drive the first blade, and a protective cover configured to cover at least a part of the detector, and the cutter support may include therein the movable blade, the drive mechanism, the detector, and the protective cover.

In the above-described configuration, the printing apparatus main body may include an accommodation unit configured to accommodate the roll paper and a lid configured to cover the accommodation unit, and the second blade may be arranged in the lid.

In the above-described configuration, the printing apparatus may include a control unit, and the control unit may control the drive mechanism to drive the first blade to cut the printing medium, control, after the cutting, the transport unit to transport the printing medium, and determine, after the transporting, an error when the detector fails to detect the printing medium.

In the above-described configuration, when breakage of a power supplying line coupled to the detector is detected, an operation of moving the first blade may not be executed.

Another aspect for solving the above-described problem is a method of controlling a printing apparatus including a printing apparatus main body and a cutter support mounted on the printing apparatus main body, the method including transporting a printing medium in a direction of discharging the printing medium from the printing apparatus main body, cutting the printing medium with a first blade supported by the cutter support and a second blade meshing with the first blade, detecting the printing medium by a detector supported by the cutter support, and determining an error when the detector fails to detect the printing medium.

DESCRIPTION OF EXEMPLARY EMBODIMENTS

1. Configuration of Printing System

Figure 1:
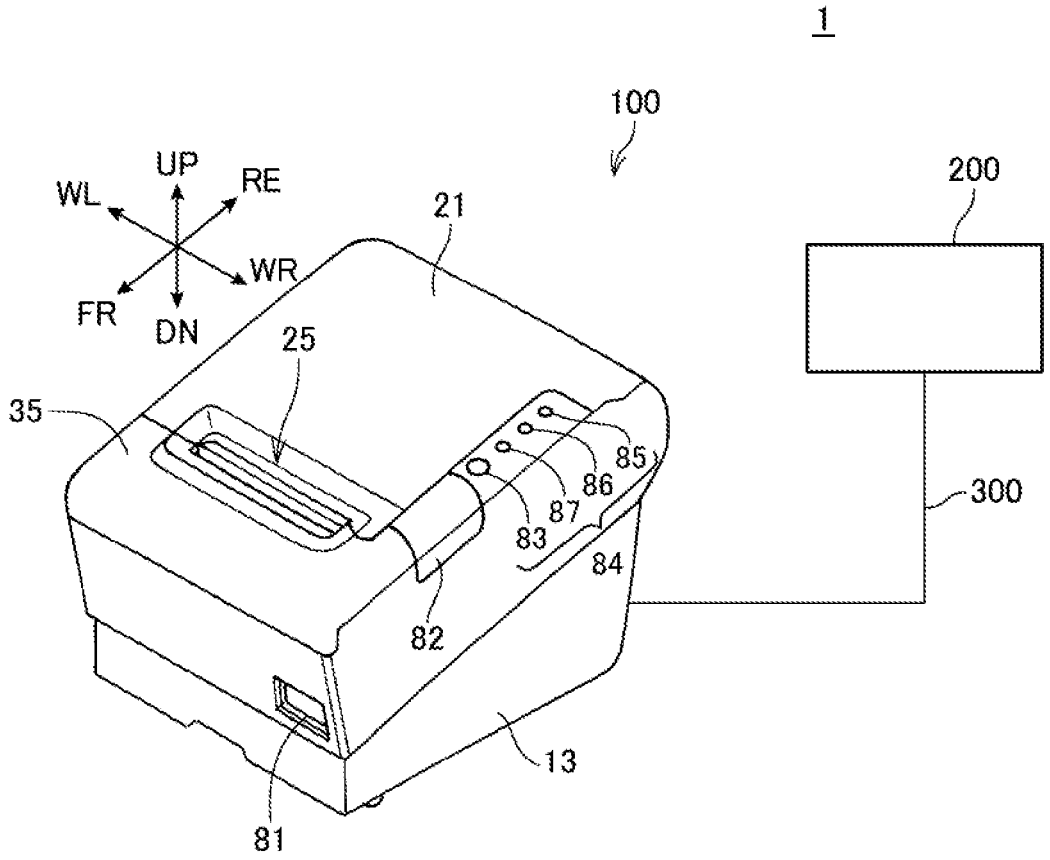
FIG. 1 is a diagram illustrating a configuration of a printing system.

FIG. 1 is a diagram illustrating a configuration of a printing system 1, where a perspective view of a visual appearance of a printer 100 is included.

The printing system 1 includes the printer 100 and a host device 200, and the printer 100 is coupled to the host device 200 by a cable 300.

The printer 100 is a printing apparatus for printing a character and an image on a printing medium having a predetermined size. As an example of the printing apparatus, the printer 100 according to the embodiment is a thermal printer for forming a character and an image by applying heat to a printing medium. The printer 100 uses a roll paper 11 in which long thermal paper is wound into a roll shape. Note that the thermal paper drawn from the roll paper 11 is an example of the printing medium (or recording paper).

The host device 200 transmits various types of commands to the printer 100. Furthermore, the host device 200 transmits a print job including a print command and print data. The printer 100 executes the command transmitted by the host device 200. When receiving the print job from the host device 200, the printer 100 executes printing on the roll paper 11, based on the print data. Furthermore, the printer 100 transmits various types of status data to the host device 200.

In the printing system 1, the printer 100 and the host device 200 may not necessarily employ a wired connection by the cable 300, but may be configured to be connected by wireless communication.

FIG. 1 illustrates an example of an installation state of the printer 100, and in the installation state of FIG. 1, the upper side is denoted by reference symbol UP, the lower side is denoted by reference symbol DN, the front side is denoted by reference symbol FR, and the rear side is denoted by reference symbol RE. Furthermore, in a width direction of the printer 100, the right side is denoted by reference symbol WR, and the left side is denoted by reference symbol WL.

Note that an installation direction of the printer 100 is not limited to the example illustrated in FIG. 1, and for example, a surface on the RE side of the printer 100 in FIG. 1 may be in contact with an installation surface.

2. Configuration of Printer

Figure 2:
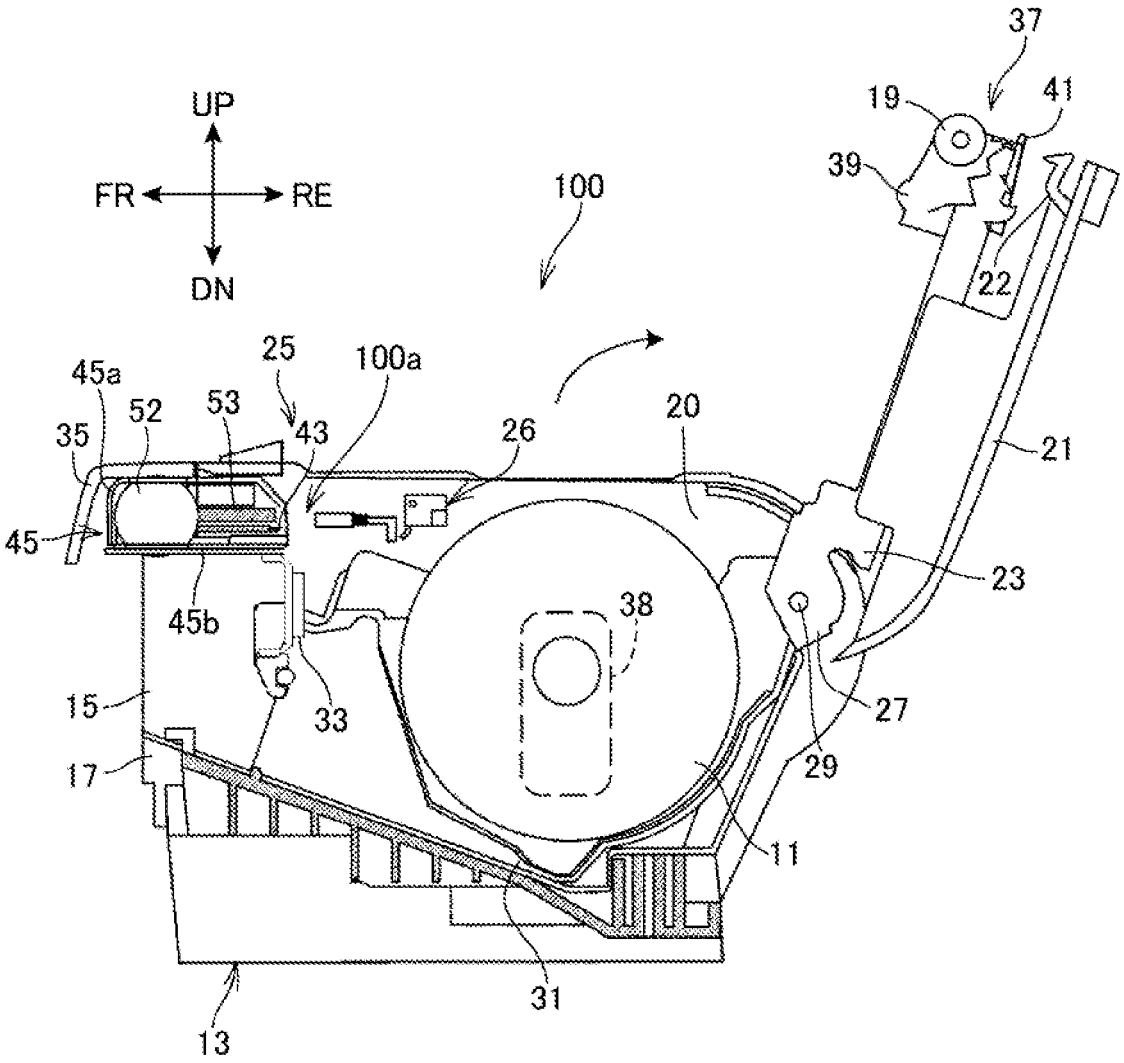
FIG. 2 is a cross-sectional view of a printer.

FIG. 2 is a cross-sectional view of the printer 100, and illustrates a state where a later-described roll paper cover 21 is opened. An overall configuration of the printer 100 will be described with reference to FIGS. 1 and 2.

The printer 100 includes a printer main body 13 whose metal main body frame 15 is covered by a main body case 17 made of resin. The printer main body 13 includes an opening portion 20 configured to accommodate the roll paper 11, the roll paper cover 21 configured to open and close the opening portion 20, and a cutter cover 35 provided on a front part of the printer 100. Inside the opening portion 20, there is a roll paper holder 31 configured to accommodate the roll paper 11, and the roll paper cover 21 covers the roll paper holder 31 when the roll paper cover 21 is closed.

The printer 100 corresponds to an example of a printing apparatus, and the printer main body 13 corresponds to an example of a printing apparatus main body. Furthermore, in the description below, the roll paper holder 31 corresponds to an example of an accommodation unit, and the roll paper cover 21 corresponds to an example of a lid. A main body 45*b* of a cutter unit 45 corresponds to an example of a cutter support body and a pickup sensor 60 corresponds to an example of a detector. A sensor cover 70 corresponds to an example of a protective cover, and a sheet transport unit 120 corresponds to an example of a transport unit.

A paper discharge port 25 is provided on a top surface of the printer 100, and the printed roll paper 11 is discharged from the paper discharge port 25.

An electrical power switch 81 is disposed on a front face of the printer main body 13. A cover open button 82 for opening the roll paper cover 21 and a control panel 84 are provided on an upper right portion of the printer main body 13.

The control panel 84 includes a paper feed switch 83, a power supply light emitting diode (LED) 85, an error LED 86, and a no-sheet LED 87. The power supply LED 85 is lighted on or off in accordance with whether the power supply of the printer 100 is ON or OFF. The error LED 86 indicates a type of error by being lighted on or blinked if there occurs an error in the printer 100. The no-sheet LED 87 is lighted on if there is no roll paper 11 or if a remaining amount thereof is small.

The paper feed switch 83 is a switch for instructing transport of the roll paper 11. Various types of switch buttons such as a non-lock push switch, for example, can be employed for the paper feed switch 83. In a normal state in which no errors occur, the printer 100 executes transport of a predetermined amount of the roller paper 11 each time the paper feed switch 83 is depressed. The predetermined amount can be optionally set by a command for specifying a line feed amount transmitted from the host device 200.

The roll paper cover 21 is configured by mounting a cover made of synthetic resin on a cover frame 23. A pair of bearing parts 27 are formed in both rear ends of the cover frame 23. The bearing parts 27 are supported to freely open and close on the main body frame 15 via the support shaft 29 so that the roll paper cover 21 rotates about a support shaft 29 located in a rear part of the printer main body 13.

A platen unit 37 configured to support a platen roller 19 is arranged on the cover frame 23. The platen unit 37 includes a release lever mechanism 22. The release lever mechanism 22 includes an engaging craw and a release lever configured to operate in conjunction with the engaging claw, and functions as a locking mechanism configured to set the roll paper cover 21 to close the main body case 17.

The platen roller 19 is driven by a transfer motor (not illustrated) to rotate, and the roll paper 11 is transported by the rotation of the platen roller 19.

The roll paper holder 31 configured to accommodate the roll paper 11 is provided inside the printer main body 13. A thermal head 33 is provided forward of the roll paper holder 31.

The thermal head 33 is disposed to face the platen roller 19 while the roll paper cover 21 is closed. The platen roller 19 and the thermal head 33 are configured to sandwich, with a predetermined pressure, the roll paper 11 drawn from the roll paper holder 31. Thus, the rotation of the platen roller 19 transports the roll paper 11 from the roll paper holder 31 toward a transport space 100*a* leading to the paper discharge port 25. The transport space 100*a* is a space formed between the roll paper 11 and the cutter cover 35, and the roll paper 11 is transported toward the paper discharge port 25 through the transport space 100*a*.

In addition, if the roller paper 11 is pressed onto the thermal head 33 by the platen roller 19 and the thermal head 33 is driven by control of a later-described control unit 180, a character or an image is formed on the roll paper 11.

The printer 100 includes a cover sensor 26 configured to detect opening and closing of the roll paper cover 21. The cover sensor 26 is a sensor disposed inside the opening portion 20 and configured to detect a closed state and an opened state of the roll paper cover 21.

The printer 100 includes a fixed blade 41 and a movable blade 43 configured to sandwich the roll paper 11 for cutting. The fixed blade 41 is supported by the roll paper cover 21 and is positioned in the vicinity of the paper discharge port 25 when the roll paper cover 21 is closed. The movable blade 43 is contained in the cutter unit 45 disposed at a front part of the printer main body 13. The fixed blade 41 and the movable blade 43 face each other while the roll paper cover 21 is closed, and configure a scissor style cutting mechanism. Note that the movable blade 43 is an example of a first blade, and the fixed blade 43 is an example of a second blade.

3. Configuration of Cutter Unit

Figure 3:
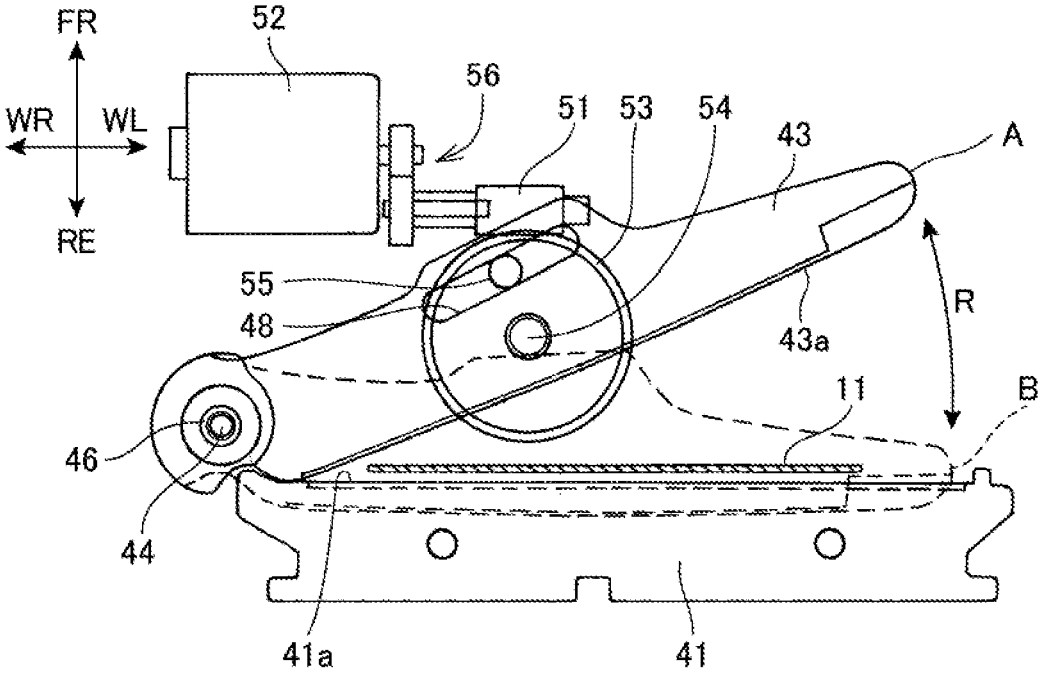
FIG. 3 is a diagram illustrating a configuration of a cutter unit.
Figure 4:
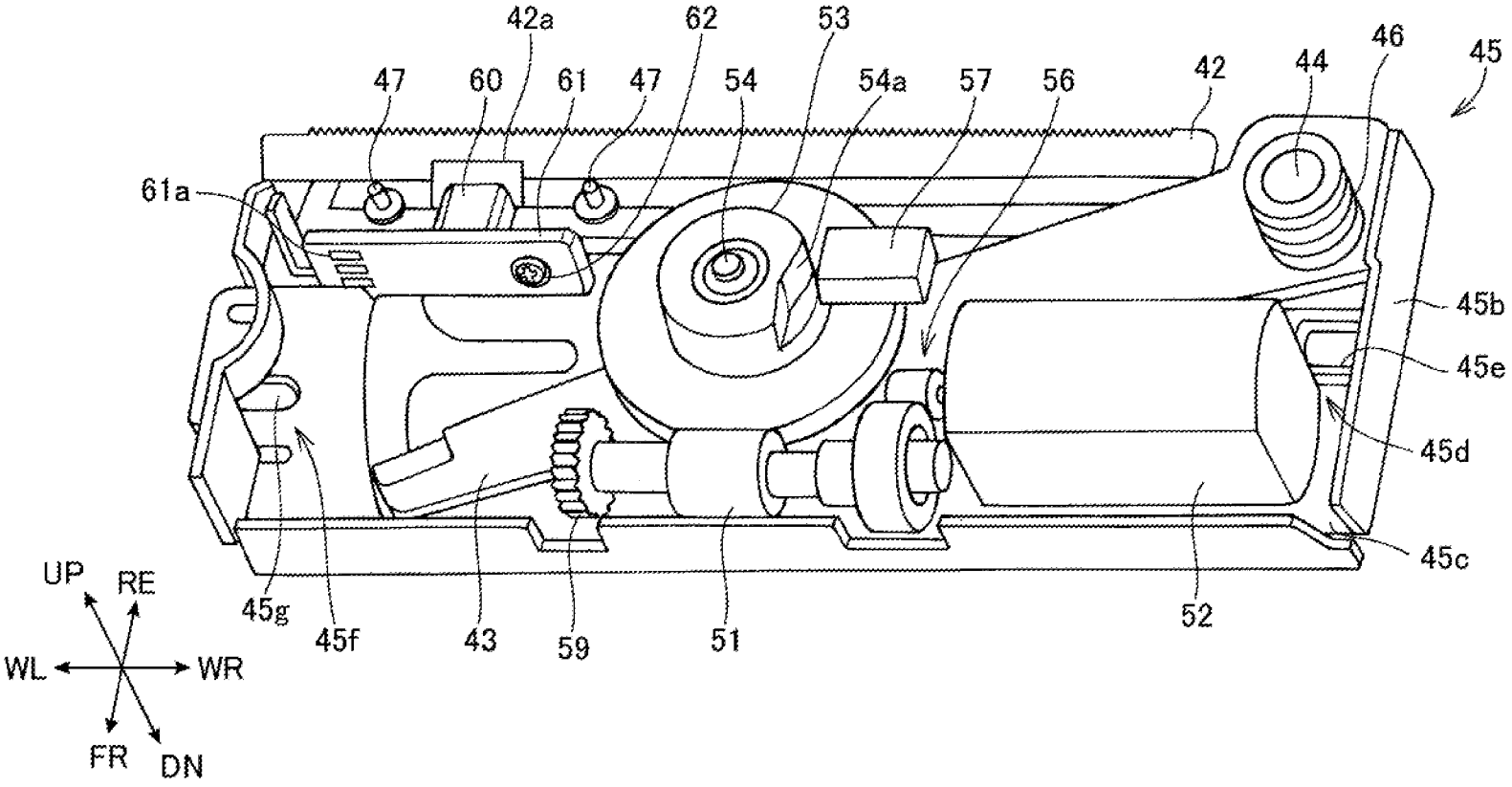
FIG. 4 is a perspective view of a main part of the cutter unit.
Figure 5:
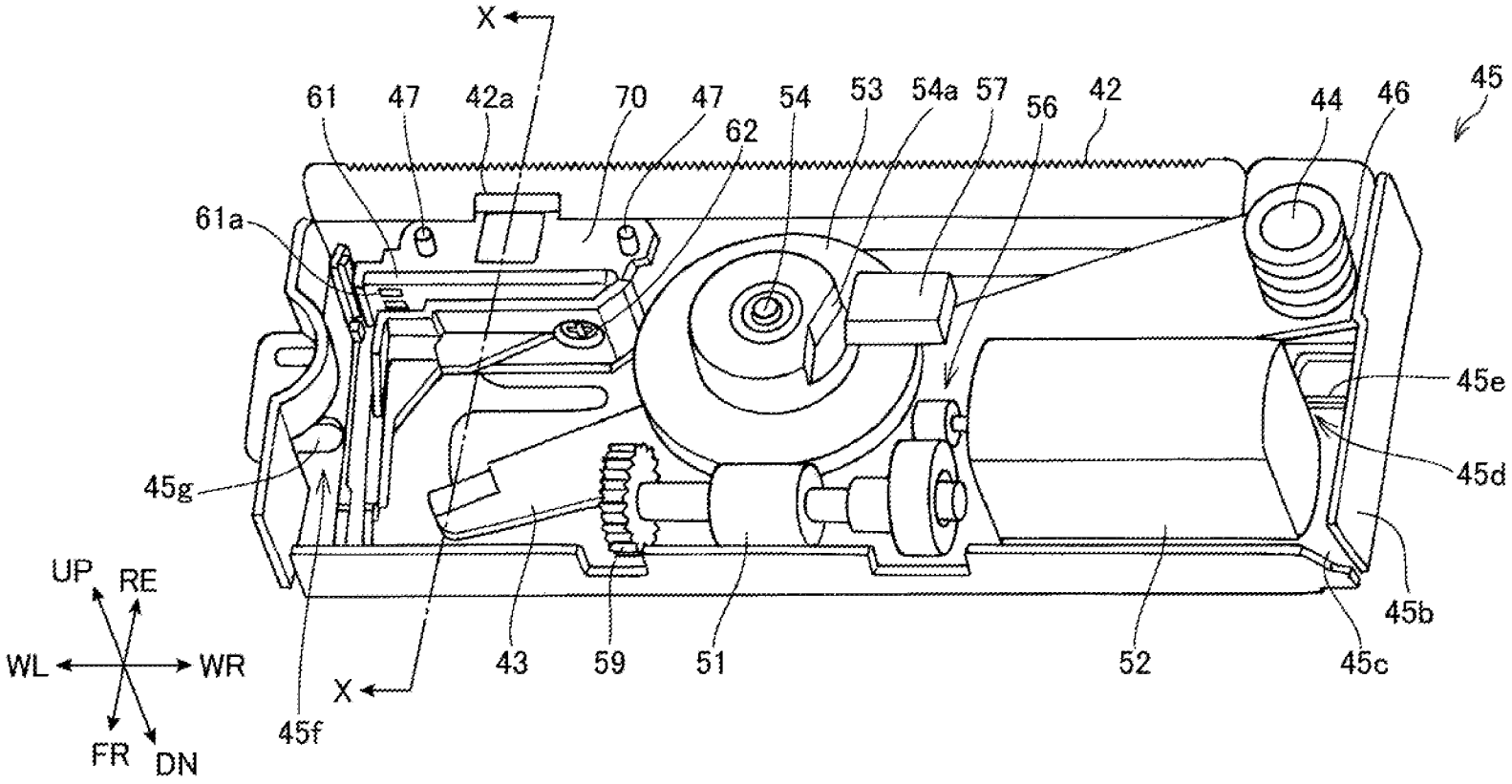
FIG. 5 is a perspective view of the main part of the cutter unit.
Figure 6:
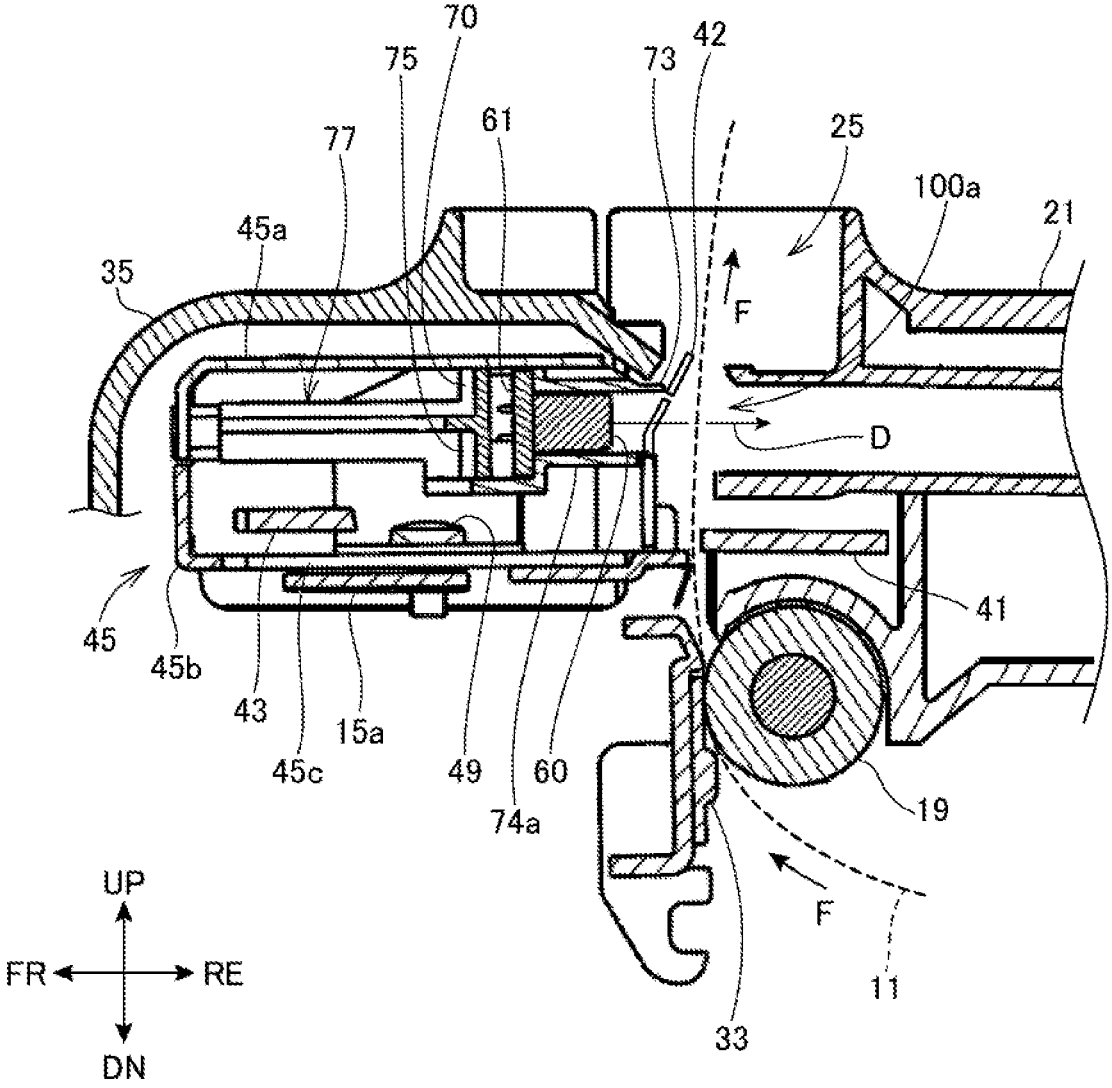
FIG. 6 is a cross-sectional view of a main part of the printer.

FIG. 3 is a view illustrating a configuration of the cutter unit 45, and illustrates in plan view a main part including the fixed blade 41 and the movable blade 43. FIG. 4 is a perspective view of a main part of the cutter unit 45, and FIG. 5 is a perspective view of a main part of the cutter unit 45. FIG. 4 and FIG. 5 illustrate a state where a cover 45*a* is removed, and FIG. 4 illustrates a state where the later-described sensor cover 70 is removed. FIG. 6 is a cross-sectional view of a main part of the printer 100, and illustrates a cross-sectional view of a portion in the vicinity of the cutter unit 45 and the fixed blade 41. The cross-section illustrated in FIG. 6 corresponds to a plane taken along X-X in FIG. 5.

With reference to these figures, the configuration of the cutter unit 45 of the printer 100 will be described.

The cutter unit 45 has the box-shaped main body 45*b* with an upper surface of the main body 45*b* covered with a cover 45*a*.

As illustrated in FIG. 3 and FIG. 4, the cutter unit 45 includes a cutter motor 52. The cutter motor 52 is coupled to a worm gear 51 via a transmission mechanism 56, including a gear, or the like and the worm gear 51 is rotated by a drive force of the cutter motor 52. The worm gear 51 meshes with a worm wheel 53. The worm wheel 53 is rotatably mounted on the main body 45*b* by a support shaft 54 and rotates in conjunction with the worm gear 51. A crank pin 55 is erected in the worm wheel 53. The crank pin 55 is fitted into a slide groove 48 provided in the movable blade 43, and the slide groove 48 and the crank pin 55 configure a crank mechanism. When the crank pin 55 moves along the slide groove 48 along with the rotation of the worm wheel 53, the movable blade 43 moves in a direction indicated by an arrow R in FIG. 3.

The movable blade 43 moves between a standby position A where a predetermined gap is formed between a blade edge 43*a* of the movable blade 43 and a blade edge 41*a* of the fixed blade 41, and a cutting end position B where the blade edge 43*a* of the movable blade 43 and the blade edge 41*a* of the fixed blade 41 overlap. In FIG. 3, the standby position A is indicated by a solid line, and the cutting end position B is indicated by a virtual line. Note that the standby position A is an example of a home position, and the cutting end position B is an example of a cut position.

The movable blade 43 is rotatably supported on the main body 45*b* by a support shaft 44. A coil spring 46 is attached to the support shaft 44 by a push nut, and the movable blade 43 is pressed against the main body 45*b* by the coil spring 46. A biasing force of the coil spring 46 maintains a pressure contact force between the blade edge 43*a* of the movable blade 43 and the blade edge 41*a* of the fixed blade 41 to be equal to or greater than a pressure contact force required to cut the roll paper 11.

When the worm wheel 53 makes one rotation with the rotation of the cutter motor 52, the movable blade 43 makes one reciprocation between the standby position A and the cutting end position B to cut the roll paper 11 positioned between the movable blade 43 and the fixed blade 41 in a width direction, that is, in a WR-WL direction.

As illustrated in FIG. 4, the main body 45*b* accommodates the transmission mechanism 56, the worm gear 51, and the cutter motor 52 serving as a drive mechanism for driving the movable blade 43. A motor knob 59 is coaxially coupled to the worm gear 51. The motor knob 59 is a gear manually operated by an operator operating the printer 100. The motor knob 59 is exposed from an opening provided in the cover 45*a*. Upon removal of the cutter cover 35 illustrated in FIG. 1, the motor knob 59 together with the cover 45*a* is exposed. In this state, the operator can manually move the movable blade 43 by manually rotating the motor knob 59.

The cutter unit 45 includes a cutter sensor 57 configured to detect a rotational position of the worm wheel 53. The cutter sensor 57 is a switch-type sensor disposed in the vicinity of the worm wheel 53. The cutter sensor 57 switches an output value between a state where the cutter sensor 57 contacts a recessed part 54*a* formed in the worm wheel 53 and a state where the cutter sensor 57 contacts with a location other than the recessed part 54*a*. The later-described control unit 180 can identify a rotational position around the support shaft 54 of the worm wheel 53, based on the output value of the cutter sensor 57, and as a result, the control unit 180 can detect whether the movable blade 43 is at the standby position A or at a position other than the standby position A.

Fixing parts 45*d* and 45*f* configured to fix the cutter unit 45 to an upper frame 15*a* are provided on a bottom plate 45*c* of the main body 45*b*. The fixing part 45*d* includes a long hole 45*e* elongating in the width direction of the printer 100, that is, in the WR-WL direction. The fixing part 45*f* includes a long hole 45*g* elongating in the WR-WL direction. The long holes 45*e* and 45*g* are fixed to opening parts drilled in the upper frame 15*a*. A bolt 49 is fastened to the upper frame 15*a* after passing through the bottom plate 45*c*, as illustrated in FIG. 6.

Since the long holes 45*e* and 45*g* elongate in the WR-WL direction, when fastening positions of the bolt 49 in the long holes 45*e* and 45*g* are changed, a relative position of the cutter unit 45 with respect to the upper frame 15*a* can be changed. That is, when the bolt 49 is loosened, the position of the cutter unit 45 with respect to the main body frame 15 can be changed in the WR-WL direction.

When the position of the cutter unit 45 with respect to the main body frame 15 is changed, a position of the movable blade 43 relative to the fixed blade 41 and a transport path of the roll paper 11 is changed. In particular, when the movable blade 43 is moved in a WR direction relative to the roll paper 11, a tip end of the blade edge 43*a* is placed inward of a side edge of the roll paper 11. In this state, when the movable blade 43 moves from the standby position A to the cutting end position B, a majority of the roll paper 11 in the WR-WL direction is cut and a remaining portion thereof is left uncut. A cutting method in which a portion of the roll paper 11 is left uncut in this way is a so-called partial cut. Use of the partial cut is convenient in that a cutting piece of the roll paper 11 does not fall out of the paper discharge port 25 and the cutting piece can be easily separated from the printer 100 by pulling the roll paper 11 by hand.

Furthermore, the amount of the cutting residue of the roll paper 11 in the partial cut can be adjusted by changing the relative position of the movable blade 43 with respect to the roll paper 11.

Thus, the printer 100 can move the relative position of the cutter unit 45 with respect to the main body frame 15 in the WR-WL direction, and thus, the printer 100 can switch between the cutting method where the roll paper 11 is completely cut and the partial cut. In addition, the amount of the cutting residue of the roll paper 11 in the partial cut can be adjusted.

In the embodiment, when the position of the cutter unit 45 with respect to the main body frame 15 is shifted in the WL direction, a cutting method is performed in which the roll paper 11 is cut off. When the position of the cutter unit 45 is shifted in the WR direction, the partial cut is executed. As the position of the cutter unit 45 is toward the WR direction, the amount of the cutting residue in the partial cut increases.

As illustrated in FIG. 4 and FIG. 5, the cutter unit 45 includes a manual cutter 42. The manual cutter 42 is a plate-like member projecting from the cutter unit 45 into the UP direction, and a blade for cutting the roll paper 11 is formed on a tip end of the manual cutter 42. If the cutter unit 45 is not used, the roll paper 11 can be cut by the manual cutter 42 when an operator pulls the roll paper 11 by hand while the roll paper 11 that is not to be cut projects from the paper discharge port 25. A position where the roll paper 11 is cut by the manual cutter 42 is downstream, in the transport path of the roll paper 11, of a cutting position where the fixed blade 41 and the movable blade 43 cut the roll paper 11. Note that the manual cutter 42 is an example of a third blade.

As illustrated in FIG. 4, the cutter unit 45 includes thereon the pickup sensor 60. The pickup sensor 60 is a sensor configured to detect the presence or absence of the roll paper 11 in the transport space 100*a*. For example, the pickup sensor 60 is a reflection-type optical sensor configured to emit light toward the transport space 100*a* to detect the roll paper 11, based on an amount of reflected light. The pickup sensor 60 may also be configured by a transmission-type optical sensor. The pickup sensor 60 may also be configured by a switch-type sensor.

The pickup sensor 60 is located in the FR direction relative to the manual cutter 42. Thus, the manual cutter 42 is located between the roll paper 11 and the pickup sensor 60. In the manual cutter 42, a detection window 42*a* is opened in alignment with a position of the pickup sensor 60 to enable the pickup sensor 60 to detect the roll paper 11. The pickup sensor 60 faces the transport space 100*a* through the detection window 42*a* so that the roll paper 11 can be optically detected.

As illustrated in FIG. 6, a detection position where the pickup sensor 60 detects the roll paper 11 is downstream, in the transport direction of the roll paper 11, of the cutting position of the fixed blade 41 and the movable blade 43. The pickup sensor 60 detects the roll paper 11 remaining in a position downstream of the cutting position when the printer 100 executes the partial cut. The later-described control unit 180 determines the presence or absence of the roll paper 11, based on output of the pickup sensor 60. When it is determined that there is no roll paper 11 from a state where the roll paper 11 is detected by the pickup sensor 60, it means that the rolled paper 11 that has been partially cut is removed by the operator. Thus, the printer 100 can use the pickup sensor 60 to identify whether or not the roll paper 11 that is partially cut to remain in the paper discharge port 25 has been removed.

The pickup sensor 60 is mounted on a sensor substrate 61 mounted on the main body 45*b*. The sensor substrate 61 is fixed to the main body 45*b* by a bis 62. Thus, if the cutter unit 45 is moved in the WR-WL direction relative to the main body frame 15, the pickup sensor 60 moves along with the cutter unit 45. Various electronic components are mounted on the sensor substrate 61, and terminals 61*a* are provided for coupling these electronic components to a circuit board 38. The terminals 61*a* are each coupled to the circuit board 38 by a lead wire, as described below.

The sensor cover 70 is attached to the pickup sensor 60.

For comparison, FIG. 5 illustrates a configuration of the cutter unit 45 including the sensor cover 70 and FIG. 4 illustrates a configuration where the sensor cover 70 is not attached. As illustrated in FIG. 5, the sensor cover 70 is a member for covering the pickup sensor 60 and a portion of the sensor substrate 61.

4. Configuration of Sensor Cover

Figure 7:
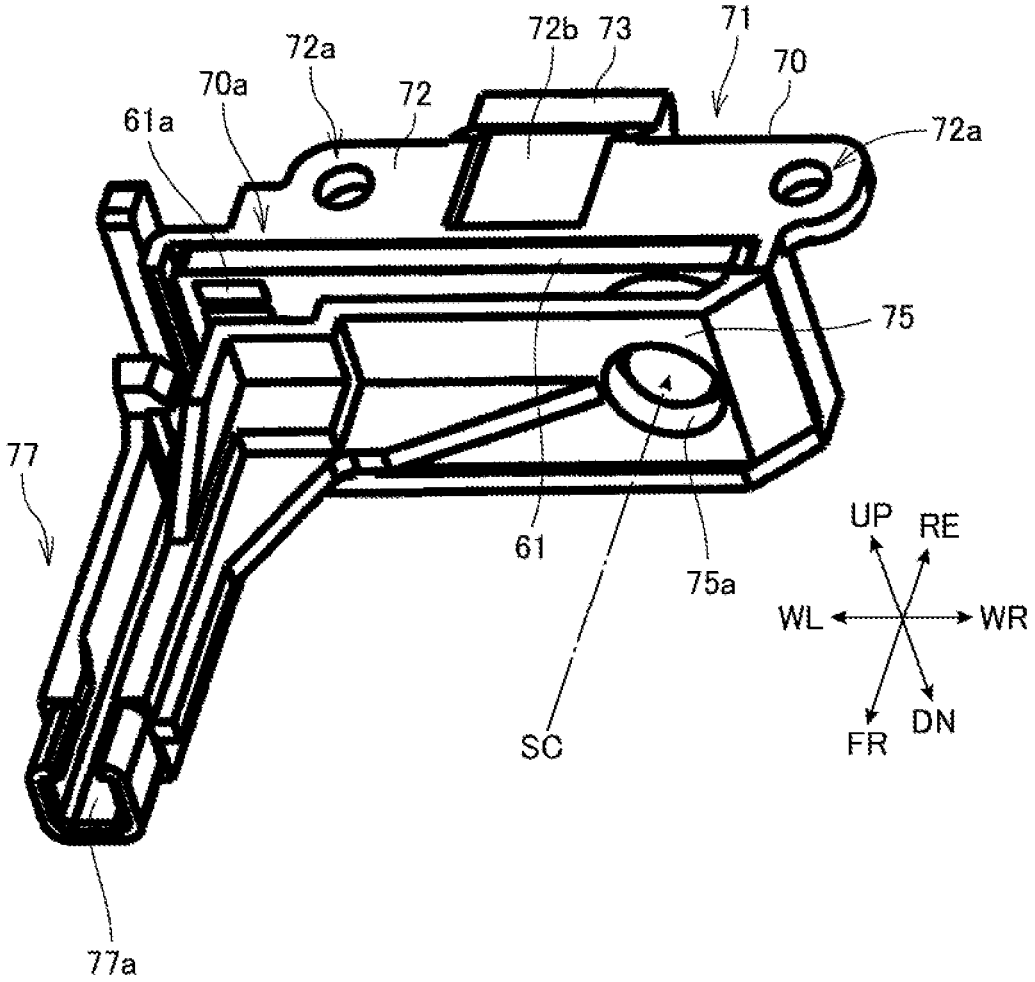
FIG. 7 is a perspective view of a sensor cover.
Figure 8:
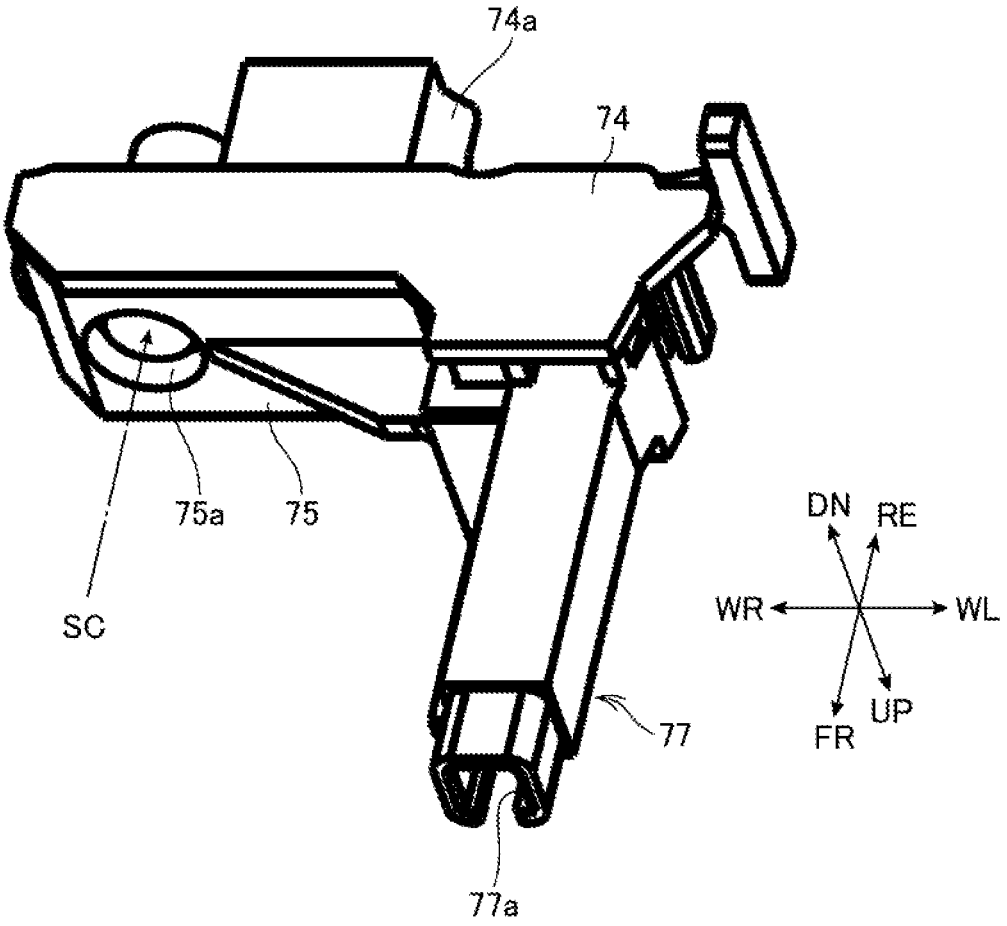
FIG. 8 is a perspective view of the sensor cover.
Figure 9:
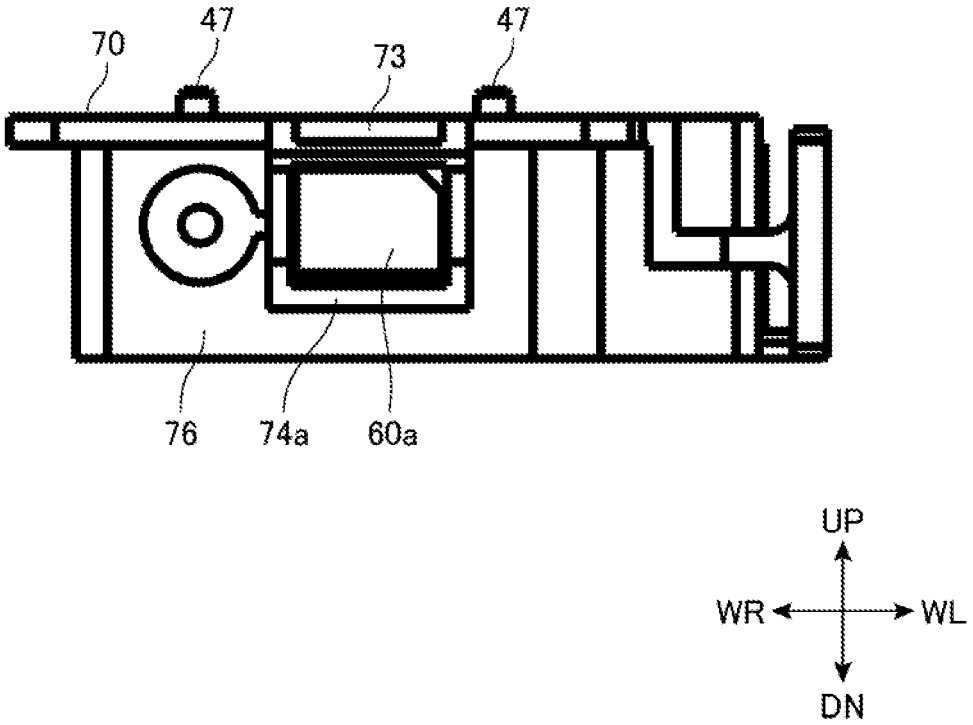
FIG. 9 is a front view of the sensor cover.

FIG. 7 is a perspective view where the sensor cover 70 is viewed from the UP direction. FIG. 8 is a perspective view where the sensor cover 70 is viewed from the DN direction. FIG. 9 is a front view where the sensor cover 70 is viewed from the RE direction. FIG. 7, FIG. 8, and FIG. 9 illustrate a state where the sensor cover 70 is attached to the pickup sensor 60. In FIG. 7, FIG. 8, and FIG. 9, directions in a state where the sensor cover 70 is attached to the cutter unit 45 are indicated by reference symbols UP, DN, FR, RE, WR, and WL, respectively. Note that in the following description, the UP direction is referred to as "up", the DN direction, "down", the FR direction, "front", the RE direction, "rear", the WR direction, "right", and the WL direction, "left", respectively. Reference symbols UP, DN, FR, RE, WR, and WL illustrated in the above figures illustrate directions in a state where the printer 100 is installed as illustrated in FIG. 1, and this is not always the case if the installation direction of the printer 100 is changed.

The sensor cover 70 includes a sensor protection unit 71, a substrate protection unit 75, and a lead wire accommodation unit 77.

The sensor protection unit 71 and the substrate protection unit 75 form a substrate accommodating groove 70*a* that is a space for accommodating the sensor substrate 61. While the sensor substrate 61 is accommodated in the substrate accommodating groove 70*a*, the sensor protection unit 71 is located on an RE side of the sensor substrate 61, and the substrate protection unit 75 is located on an FR side of the sensor substrate 61. The lead wire accommodation unit 77 extends, in the FR direction, from the substrate protection unit 75.

A top surface 72 of the sensor protection unit 71 is a plane covering the top of the pickup sensor 60. In the top surface 72, a surface 72*b* located directly above the pickup sensor 60 is recessed relative to a surrounding area of the surface 72*b*, and a rear surface of the surface 72*b* abuts against the pickup sensor 60. Two fixing holes 72*a* are drilled in the top surface 72 for fixing the sensor cover 70 to the cutter unit 45. Pins 47, which are erected on the main body 45*b* of the cutter unit 45, pass through the fixing holes 72*a* for fixation.

In the surface 72*b*, a canopy part 73 projects toward the transport space 100*a*. The canopy part 73 projects in the RE direction on an UP side of the pickup sensor 60 to cover the UP side of the pickup sensor 60.

The sensor protection unit 71 includes a lower protection surface 74 located on the DN side of the pickup sensor 60. The lower protection surface 74 is a surface covering a bottom of the sensor substrate 61, as illustrated in FIG. 8. The lower protection surface 74 includes a sensor-lower-part protection unit 74*a* that projects along the pickup sensor 60. The sensor-lower-part protection unit 74*a* has a frame shape covering a bottom and a lateral side of the pickup sensor 60, as illustrated in FIG. 9. Thus, the pickup sensor 60 projecting from the sensor substrate 61 toward the transport space 100*a* is surrounded by the surface 72*b* and the sensor-lower-part protection unit 74*a*. On the other hand, there are no members that impair detection between a detection surface 60*a* of the pickup sensor 60 to be used to detect light and the transport space 100*a*.

The substrate protection unit 75 covers a surface on the FR side of the sensor substrate 61. The substrate protection unit 75 includes a bis hole 75*a* through which the bis 62 penetrates in a direction indicated by reference symbol SC. The substrate protection unit 75 is fixed to the sensor substrate 61 and the main body 45*b* by the bis 62.

The lead wire accommodation unit 77 is configured integrally with the substrate protection unit 75. The lead wire accommodation unit 77 is a cylinder extending in the FR direction from the sensor substrate 61, and includes a groove 77*a* extending from the substrate accommodating groove 70*a* toward the FR side of the cutter unit 45. The groove 77*a* can accommodate a lead wire (not illustrated) coupled to each of the terminals 61*a* of the sensor substrate 61. This lead wire is drawn out of the cutter unit 45 and is coupled to the circuit board 38 for supplying power to the pickup sensor 60 and outputting a detection value.

The sensor cover 70 has a function of protecting the pickup sensor 60, the sensor substrate 61, and the lead wires coupled to the sensor substrate 61. In particular, with the sensor cover 70, protection from lubricants, paper powders, and external light is achieved.

The cutter unit 45 includes the worm gear 51, the worm wheel 53, the crank pin 55, the transmission mechanism 56, and the like which are drive mechanisms for moving the movable blade 43. A lubricant such as grease for lubrication or rust-proofing is applied to a sliding part or a fitting part of these mechanisms, and thus, the lubricant may adhere to the pickup sensor 60 and the sensor substrate 61.

In the printer 100, when the sensor cover 70 is disposed, it is possible to protect the pickup sensor 60 and the sensor substrate 61 from adherence of the lubricant. In the sensor cover 70, the FR side of the sensor substrate 61 is covered by the substrate protection unit 75, the UP side of the pickup sensor 60 is covered by the top surface 72, and the DN side of the pickup sensor 60 is covered by the lower protection surface 74. Thus, the pickup sensor 60 and the sensor substrate 61 may be protected from adherence of lubricant scattered from the drive mechanism of the cutter unit 45.

Also, an outer periphery of the pickup sensor 60 is surrounded by the surface 72*b* of the sensor cover 70 and the sensor-lower-part protection unit 74*a*. Thus, light in a direction different from the direction of light incident from the transport space 100*a* on the detection surface 60*a* can be blocked. Accordingly, when external light acting as an external disturbance is blocked or reduced upon detection of the light by the pickup sensor 60, it is possible to improve a detection accuracy obtained when the pickup sensor 60 is used.

Furthermore, the canopy part 73 projects on the UP side of the pickup sensor 60, and thus, the external light incident from the paper discharge port 25 can be more effectively blocked.

In addition, in the pickup sensor 60, the surfaces excluding the detection surface 60*a* are covered with the sensor cover 70, and therefore, even if paper powder is generated from the roll paper 11 passing through the transport space 100*a*, the paper powder is unlikely to adhere to the pickup sensor 60. Therefore, the adhesion of the paper powder to the pickup sensor 60 can be prevented or reduced by the sensor cover 70.

5. Adjustment of Amount of Cutting Residue

Figure 10:
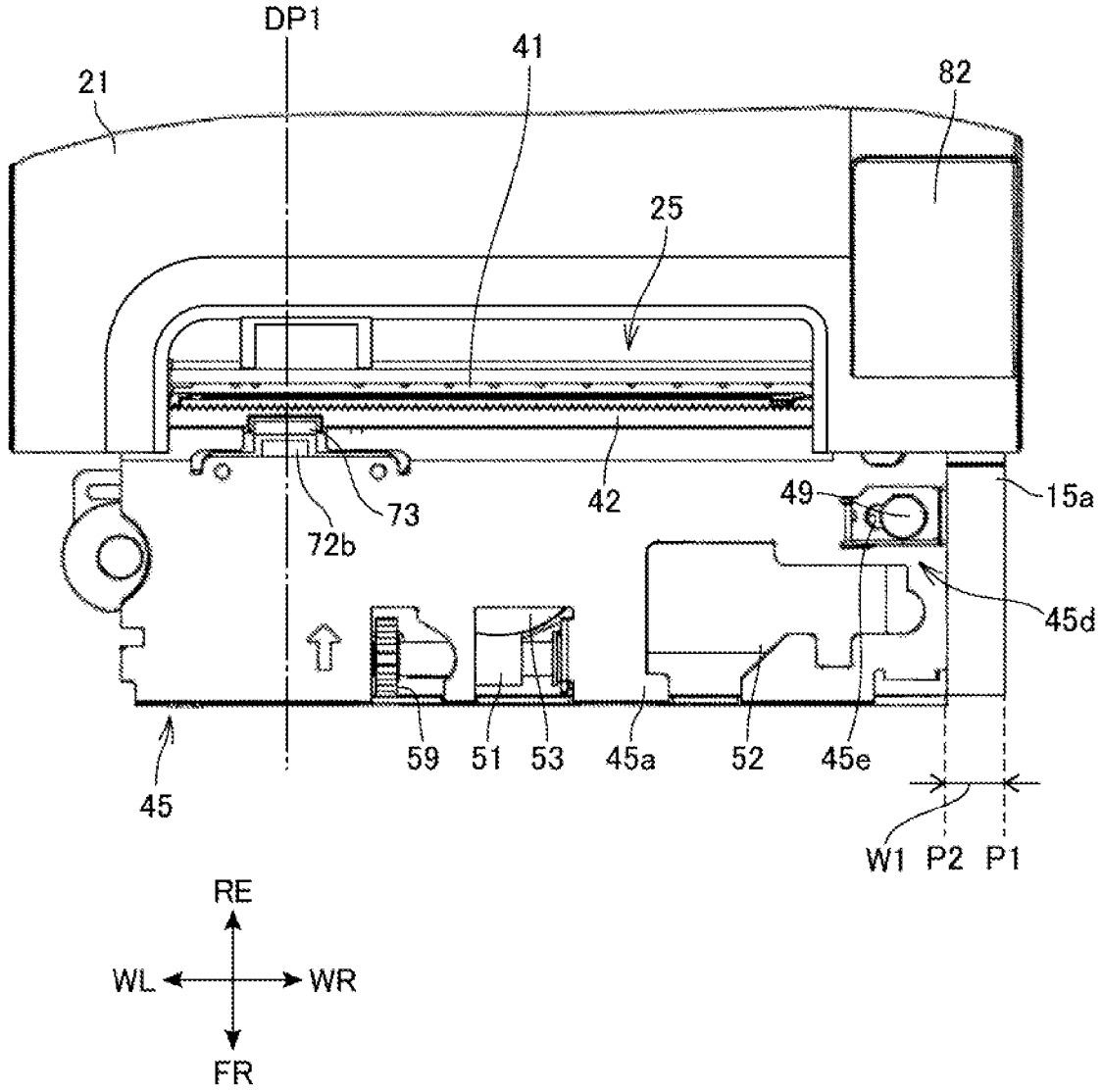
FIG. 10 is a plan view of a main part of the printer.
Figure 11:
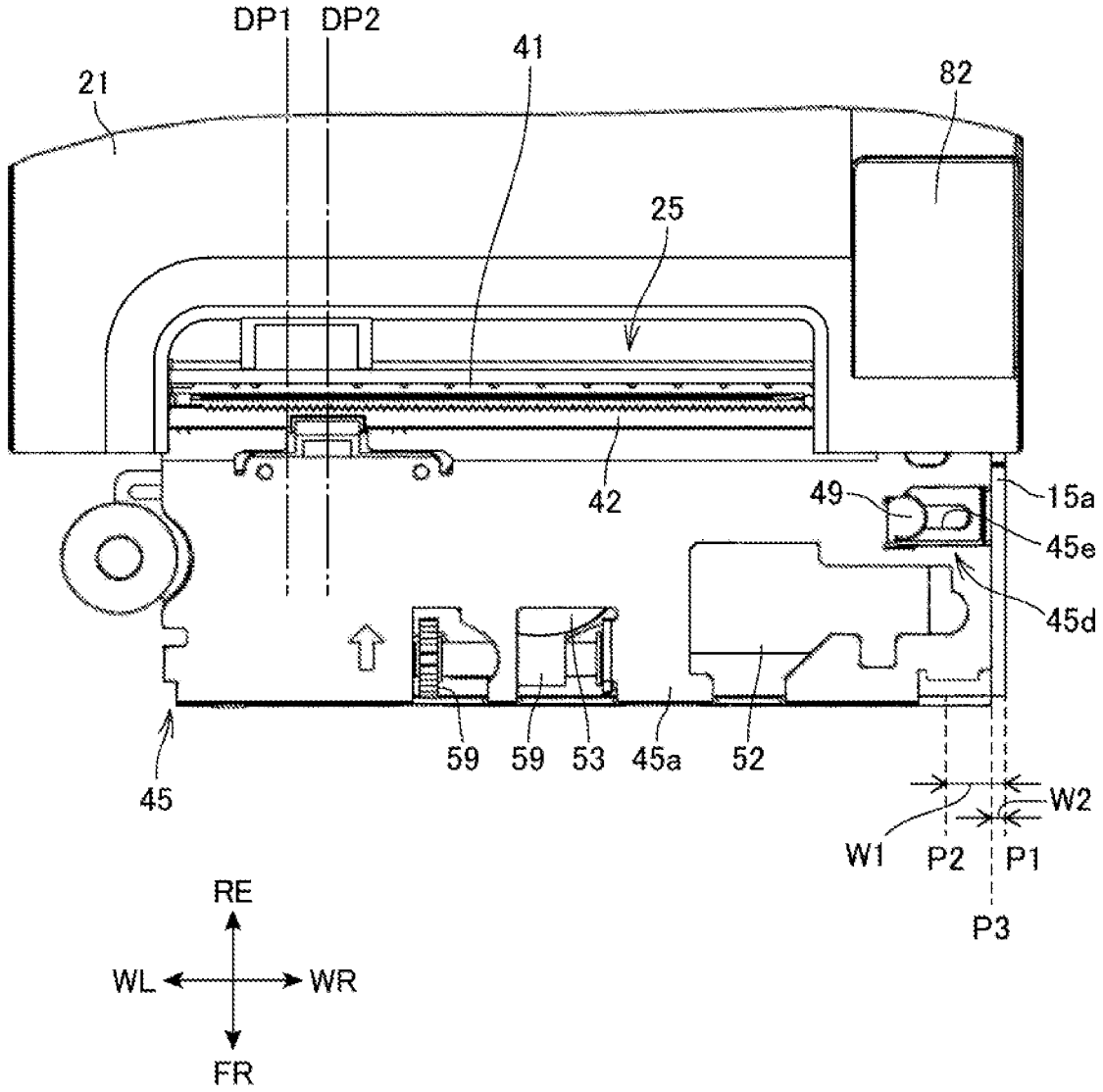
FIG. 11 is a plan view of the main part of the printer.

FIG. 10 and FIG. 11 are plan views of a main portion of the printer 100, and are diagrams explaining adjustment of the amount of the cutting residue of the roll paper 11.

For comparison, FIG. 10 and FIG. 11 illustrate two states in which the partial cut is performed, with different amounts of the cutting residue. FIG. 10 illustrates a state where there is less amount of the cutting residue than the state illustrated in FIG. 11.

FIG. 10 and FIG. 11 illustrate a state where the cover 45*a* is attached to the cutter unit 45. Removal of the cutter cover 35 of the printer 100 results in the states illustrated in FIG. 10 and FIG. 11.

A plurality of windows open in the cover 45*a*, and the operator can view an internal structure of the cutter unit 45 from these openings. For example, operating states of the worm gear 51, the cutter motor 52, and the worm wheel 53 can be viewed through the openings of the cover 45*a*.

A portion of the motor knob 59 is exposed through one of the openings of the cover 45*a* and the motor knob 59 can be manually rotated. The operator may operate the motor knob 59 with the cutter cover 35 being removed to manually move the movable blade 43.

As illustrated in FIG. 4, the cutter unit 45 is fixed to the printer main body 13 by fixing the fixing parts 45*d* and 45*f* formed on the main body 45*b* with bolts to the upper frame 15*a*. In the fixing parts 45*d* and 45*f*, the bolts pass through the long holes 45*e* and 45*g* elongating in the WR-WL direction. FIG. 10 and FIG. 11 illustrate the bolt 49 passing through the long hole 45*e*. While the both of the bolt 49 and the bolt (not illustrated) passing through the long hole 45*g* are loosened, the main body 45*b* can be moved in the WR-WL direction relative to the upper frame 15*a*.

In FIG. 10, a reference position on the WR side of the upper frame 15*a* is indicated by a position P1, a position of an end on the WR side of the cutter unit 45 is indicated by a position P2, and a distance between the position P1 and the position P2 is a distance W1. A detection position of the pickup sensor 60 is indicated by reference symbol DP1.

A state of FIG. 11 is a state in which the cutter unit 45 is moved in the WR direction relative to the upper frame 15*a* from the position illustrated in FIG. 10, where the end on the WR side of the cutter unit 45 moves from the position P2 to a position P3. A distance W2 between the position P3 and the reference position P1 of the upper frame 15*a* is smaller than the distance W1.

When FIG. 10 is compared with FIG. 11, it can be understood that the cutter unit 45 moves to the WR side by a difference between the distance W1 and the distance W2, relative to the printer main body 13. Along with the movement of the cutter unit 45, the movable blade 43 is moved in the WR direction relative to the fixed blade 41 and the roll paper 11. Thus, in the state of FIG. 11, the movable blade 43 separates from the end on the WL side of the roll paper 11, and therefore, the amount of the cutting residue in the partial cut increases than that in FIG. 10.

The pickup sensor 60 is fixed to the main body 45*b*. Thus, when the cutter unit 45 moves in the WR-WL direction, the pickup sensor 60 also moves along with the cutter unit 45. In the state illustrated in FIG. 11, the detection position of the pickup sensor 60 moves in the WR direction relative to a position DP1, and thus, is a position DP2.

In addition, although not illustrated, when the cutter unit 45 is moved in the WL direction from the position in FIG. 10, it is possible to execute a cutting method for cutting off the roll paper 11.

In this way, in the printer 100, when the cutter unit 45 is moved in the WR-WL direction with respect to the printer main body 13, the position at which the movable blade 43 cuts the roll paper 11 can be changed in the WR-WL direction. As a result, the amount of the cutting residue in the partial cut can be adjusted.

In addition, the detection position of the pickup sensor 60 moves in the WR-WL direction to follow change in amount of the cutting residue in the partial cut.

When the roll paper 11 is partially cut, a portion left uncut is broken by the operator. The resulting broken line is not necessarily a horizontal line. For example, the roll paper 11 may be broken to trace a line extending in the UP direction, and an unbroken roll paper 11 on the side of the roll paper holder 31 may possibly interfere with the detection position of the pickup sensor 60. However in a position near the cutting line obtained when the movable blade 43 cuts the roll paper 11, the broken line of the roll paper 11 is close to the cutting positions of the fixed blade 41 and the movable blade 43. Thus, even if the broken line is not horizontal, it is unlikely that the unbroken roll paper 11 interferes with the detection position of the pickup sensor 60.

Thus, it is preferable that the detection position of the pickup sensor 60 be close to the end of the cutting line of the movable blade 43 because it is possible to accurately determine whether or not the roll paper 11 is removed by the operator. In addition, when the movable blade 43 moves relative to the roll paper 11, the detection position of the pickup sensor 60 preferably moves in response to the movement of the movable blade 43. In this regard, the configuration of the printer 100 described with reference to FIG. 10 and FIG. 11 is excellent.

6. Control System of Printer

Figure 12:
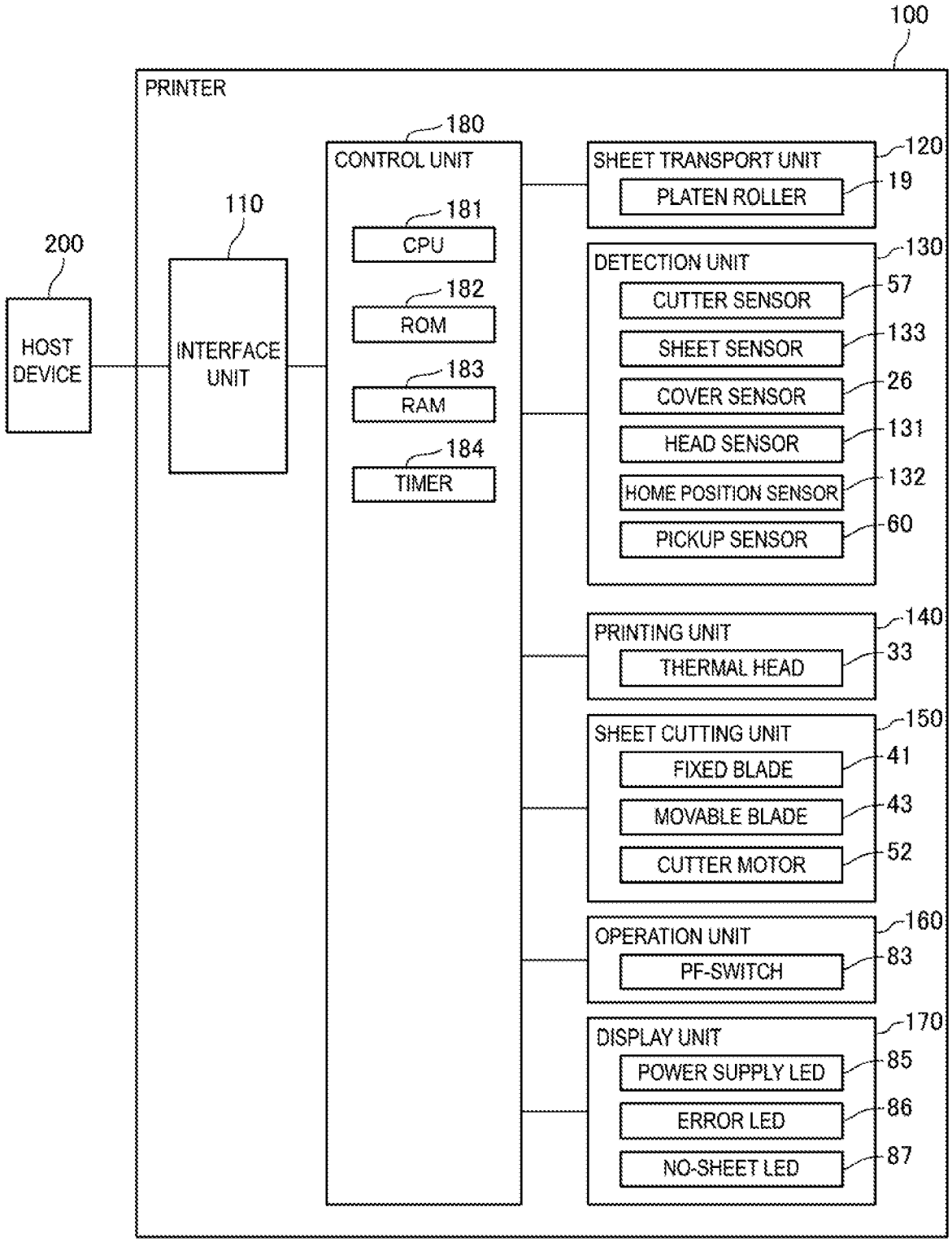
FIG. 12 is a function block diagram of the printer.

FIG. 12 is a functional block diagram of the printer 100.

The printer 100 includes an interface unit 110, the sheet transport unit 120, a detector 130, a printing unit 140, a sheet cutting unit 150, an operation unit 160, a display unit 170, and the control unit 180.

In accordance with the control of the control unit 180, the interface unit 110 receives a command and data transmitted by the host device 200 and transmits data to the host device 200.

The interface unit 110 receives, from the host device 200, a print job for instructing the printer 100 to perform printing, a setting command for specifying a setting value to the printer 100, and the like. The print job includes a print command for instructing the printer 100 to perform printing and print data. The print data includes a character or an image to be printed on the roll paper 11. The print job may also include a cutter command for instructing the printer 100 to cut the roll paper 11, or may include a transport command for instructing the printer 100 to transport the roll paper 11. The host device 200 may transmit the cutter command and the transport command to be included in the print job, or may transmit these commands subsequently to the print job.

The sheet transport unit 120 includes the platen roller 19 and a roller drive motor (not illustrated), and transports the roll paper 11.

The detector 130 includes the cutter sensor 57, a sheet sensor 133, the cover sensor 26, a head sensor 131, a home position sensor 132, and the pickup sensor 60. The sheet sensor 133 is a sensor configured to detect that there is no remaining amount of the roll paper 11 set in the roll paper holder 31 or that the remaining amount is decreased. The head sensor 131 is a sensor configured to detect a temperature of the thermal head 33. The home position sensor 132 is a sensor configured to detect that the movable blade 43 is at the standby position A.

The control unit 180 detects an auto-cutter error indicating an abnormality in operations of the movable blade 43, based on a detection value of the cutter sensor 57 or the home position sensor 132. For example, the control unit 180 determines that an "auto-cutter error" occurs when the movable blade 43 does not return to the standby position A within a set time period after the movable blade 43 is moved from the standby position A to the cutting end position B to cut the roll paper 11. Note that the control unit 180 is an example of a processor.

The printing unit 140 includes the thermal head 33. The printing unit 140 performs printing on the roll paper 11 by selectively applying energy to a plurality of heat generating elements provided in the thermal head 33.

The sheet cutting unit 150 includes the fixed blade 41, the movable blade 43, and the cutter motor 52 so that the roll paper 11 is cut.

The operation unit 160 includes the aforementioned paper feed switch 83.

The display unit 170 includes the power supply LED 85, the error LED 86, and the no-sheet LED 87.

The control unit 180 includes a Central Processing Unit (CPU) 181, a Read Only Memory (ROM) 182, a Random Access Memory (RAM) 183, and a timer 184.

The CPU 181 executes a program stored in the ROM 182 to realize a control function of the control unit 180 to control each unit of the printer 100. That is, the CPU 181 realizes a function of the control unit 180 as a result of cooperative use of software and hardware.

The ROM 182 stores a program executed by the CPU 181 and data processed by the CPU 181 in a non-volatile manner.

The RAM 183 forms a work area for temporarily storing the program executed by the CPU 181 and the data processed by the CPU 181. The RAM 183 temporarily stores a command or data received by the interface unit 110 from the host device 200.

The control unit 180 may be configured of hardware in which the CPU 181, the ROM 182, and the RAM 183 are integrated, and may include a plurality of processors.

The CPU 181 executes a print command received by the interface unit 110, operates the sheet transport unit 120 and the printing unit 140, and controls so that a character or an image is printed on the roll paper 11. The CPU 181 also executes a cutter command received by the interface unit 110, and operates the cutter motor 52 to cut the roll paper 11 with the cutter unit 45. Additionally, by executing a transport command received by the interface unit 110, or in response to the operation of the paper feed switch 83, the CPU 181 operates the sheet transport unit 120 to transport the roll paper 11.

The CPU 181 monitors a state of the printer 100, based on a detection value of each of the sensors provided in the detector 130, when controlling the sheet transport unit 120, the printing unit 140, and the sheet cutting unit 150 to execute the operations. Based on the detection value of the detector 130, the CPU 181 detects an error occurrence in a case where a condition for an abnormality occurrence is satisfied.

7. Operation of Printer

Figure 13:
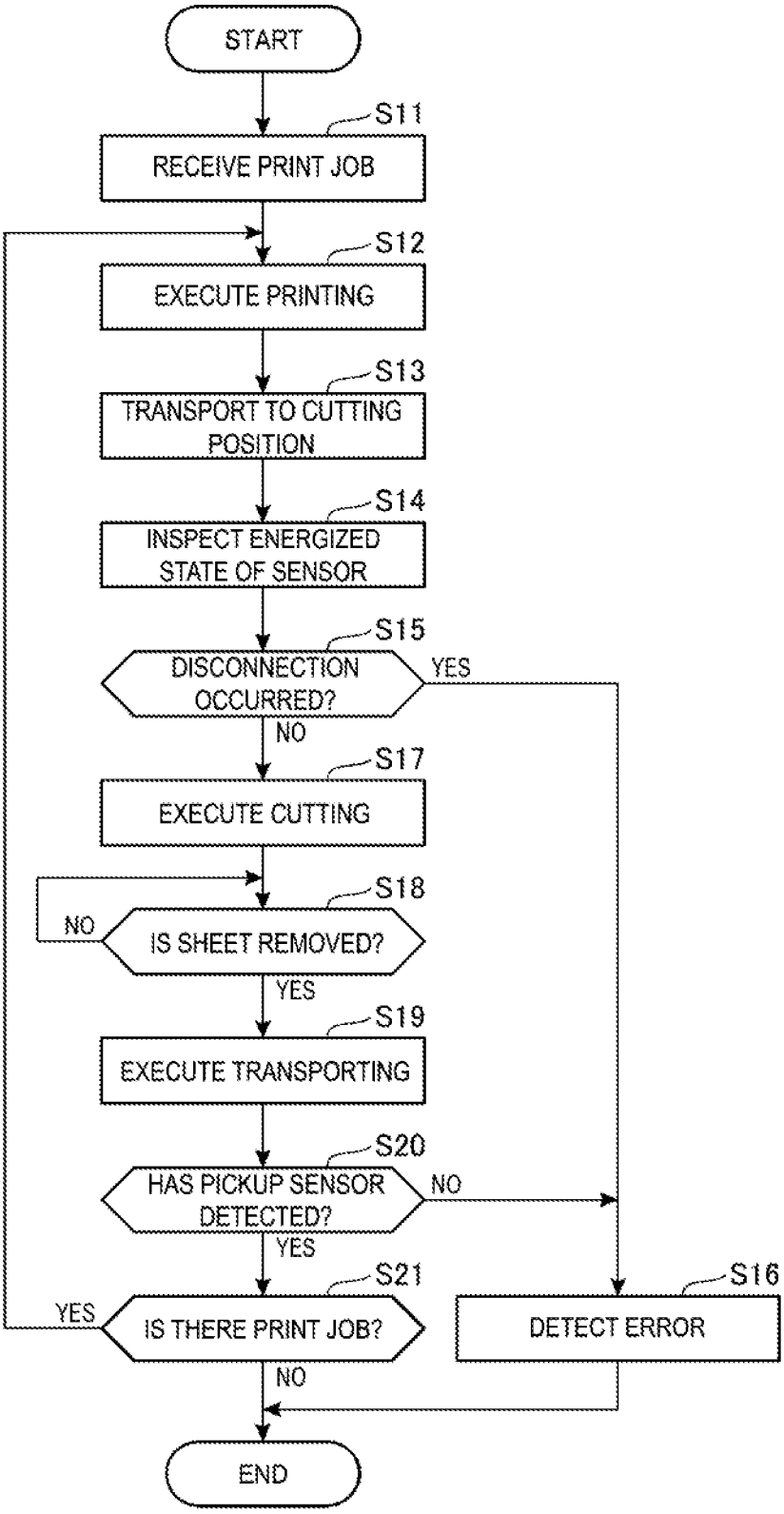
FIG. 13 is a flowchart illustrating an operation of the printer.

FIG. 13 is a flowchart illustrating an operation of the printer 100. The operations shown in steps S11 to S21 of FIG. 13 are realized when the control unit 180 controls each unit of the printer 100.

In response to the print job being received by the interface unit 110 (step S11), the control unit 180 controls the sheet transport unit 120 and the printing unit 140 according to a print command included in the print job to perform printing on the roll paper 11 (step S12). Step S12 includes an operation of forming a character or an image on the roll paper 11 by the thermal head 33, and an operation of transporting the roll paper 11 by each line by the sheet transport unit 120.

The control unit 180 uses the sheet transport unit 120 to transport the printed roll paper 11 to a position at which the printed roll paper 11 is cut by the fixed blade 41 and the movable blade 43 (step S13). The control unit 180 executes an inspection of an energized state of the pickup sensor 60 (step S14). In step S14, the control unit 180 detects the energized state for the pickup sensor 60. For example, the control unit 180 detects a resistance value of a circuit for supplying power to the pickup sensor 60. The control unit 180 determines whether or not a lead wire coupling the circuit board 38 and the pickup sensor 60 is uncoupled, based on a magnitude between a detected resistance value and a preset threshold value.

Based on an inspection result of step S14, the control unit 180 determines whether or not the breakage occurs (step S15). If it is determined that the breakage occurs (step S15; YES), the control unit 180 detects an error (step S16). In a case where the error is detected, the control unit 180 notifies the error occurrence by lighting or blinking the error LED 86, and stops the sheet transport unit 120, the printing unit 140, and the sheet cutting unit 150.

If it is determined that the breakage does not occur (step S15; NO), the control unit 180 operates the sheet cutting unit 150 to move the movable blade 43 to cut the roll paper 11 (step S17). Thereafter, the control unit 180 monitors the detection value of the pickup sensor 60 to determine whether the cut rolled paper 11 is removed (step S18). While the roll paper 11 is not removed (step S18; NO), the control unit 180 continues monitoring.

Upon detection that the roll paper 11 is removed (step S18; YES), the control unit 180 controls the sheet transport unit 120 to transport the roll paper 11 in order to start a next printing (step S19). The control unit 180 determines whether the pickup sensor 60 detects the roll paper 11 (step S20). If the roll paper 11 is not detected by the pickup sensor 60 after the control unit 180 executes a control for transporting a required amount of the roll paper 11 in step S19 (step S20; NO), the control unit 180 detects the error (step S16).

If the pickup sensor 60 detects the roll paper 11 (step S20; YES), the control unit 180 determines whether there is an unexecuted print job received by the interface unit 110 (step S21). If there is an unexecuted print job (step S21; YES), the control unit 180 returns to step S12 to execute the print job. If there is no unexecuted print jobs (step S21; NO), the control unit 180 ends the processing.

Of the errors to be notified in step S16, the error detected by the determination result in step S15 is a breakage error. On the other hand, the error detected by the determination result in step S20 is a transport abnormality of the roll paper 11, and this error is detected, for example, when the roll paper 11 is clogged. The paper clogging is an abnormality referred to as "paper jam". In step S16, different notifications may be made depending on the type of error.

As described above, the printer 100 according to the embodiment to which the present disclosure is applied includes the printer main body 13 and the main body 45*b* of the cutter unit 45 configured to change an attachment position with respect to the printer main body 13. The printer 100 includes the fixed blade 41, the movable blade 43 that can mesh or contact with the fixed blade 41 to cut the roll paper 11, and the pickup sensor 60 configured to detect the roll paper 11. The movable blade 43 and the pickup sensor 60 are supported by the main body 45*b*. With a change of the attachment position of the main body 45*b*, the amount of the remaining portion of the roll paper 11 after being cut by the movable blade 43 changes.

According to the printer 100 to which the printing apparatus of the present disclosure is applied, the pickup sensor 60 configured to detect the roll paper 11 is disposed in the cutter unit 45 configured to support the movable blade 43 configured to cut the roll paper 11. Then, when the relative position of the cutter unit 45 with respect to the printer main body 13 is moved in the WR-WL direction, the cutting position where the movable blade 43 cuts the roll paper 11 can be moved. As a result, the amount of the cutting residue in the partial cut can be adjusted. Furthermore, when the cutting position of the movable blade 43 is moved, the detection position where the pickup sensor 60 detects the roll paper 11 moves in the WR-WL direction. Thus, the roll paper 11 can be detected by the pickup sensor 60 at a position corresponding to the cutting position of the movable blade 43. Therefore, it is possible to more accurately determine whether or not the roll paper 11 is removed when the partial cut is performed, based on the detection value of the pickup sensor 60. For example, the detection of the roll paper 11 will not be hindered resulting from a state of the broken line where the roll paper 11 is broken apart by the operator. In this way, according to the printer 100 of the present disclosure, the amount of the cutting residue in the partial cut can be changed, and it is possible to achieve an appropriate and effective placement of the pickup sensor 60 configured to detect the roll paper 11.

The printer 100 includes the sheet transport unit 120 configured to transport the roll paper 11. The pickup sensor 60 is disposed downstream of the movable blade 43 in the transport direction of the roll paper 11. Thus, the pickup sensor 60 configured to detect the roll paper 11 cut by the movable blade 43 can be disposed to be accommodated in the cutter unit 45.

The printer 100 includes a drive mechanism configured to drive the movable blade 43. The drive mechanism may include the cutter motor 52, the worm gear 51, the worm wheel 53, the crank pin 55, and the transmission mechanism 56. The drive mechanism may also include the slide groove 48 formed in the movable blade 43. The printer 100 includes the sensor cover 70 covering at least a part of the pickup sensor 60, and inside the main body 45*b* of the cutter unit 45, the movable blade 43, the drive mechanism, the pickup sensor 60, and the sensor cover 70 are disposed. In this configuration, if a lubricant and the like are scattered from the drive mechanism of the movable blade 43, effects caused by the lubricant and the like on the operation of the pickup sensor 60 can be prevented or mitigated by the sensor cover 70. Thus, the pickup sensor 60 can be stably operated in a configuration in which the pickup sensor 60 is accommodated in the cutter unit 45 including the drive mechanism.

The printer main body 13 of the printer 100 includes the roll paper holder 31 configured to accommodate the roll paper 11 and the roll paper cover 21 configured to cover the roll paper holder 31. The fixed blade 41 is provided on the roll paper cover 21. In the printer 100, the pickup sensor 60 is installed in a limited space in a configuration in which the roll paper 11 can be set between the fixed blade 41 and the movable blade 43 by opening and closing the roll paper cover 21.

The roll paper 11 is discharged from the printer main body 13 through the transport space 100*a* between the movable blade 43 and the fixed blade 41. The pickup sensor 60 is an optical sensor disposed toward the transport space 100*a*, and is configured to detect the presence or absence of the roll paper 11 in the transport space 100*a*. In the printer 100, the pickup sensor 60 configured to optically detect the roll paper 11 discharged from the printer main body 13 is installed in a limited space.

The printer 100 includes the control unit 180 configured to acquire a detection state of the pickup sensor 60 and to control the sheet transport unit 120 and the sheet cutting unit 150. The control unit 180 controls to drive the movable blade 43 by the sheet cutting unit 150 including the drive mechanism to cut the roll paper 11, and then, to transport the roll paper 11 by the sheet transport unit 120. If the roll paper 11 is not detected by the pickup sensor 60 thereafter, the printer 100 determines that an error is generated. Thus, the pickup sensor 60 can be used to detect paper clogging occurring during transport after the roll paper 11 is cut.

The control unit 180 does not execute an operation of moving the movable blade 43 in a case where breakage is detected in a lead wire such as a feeder line coupled to the pickup sensor 60. Since the movable blade 43 is not moved in a state in which the detection by the pickup sensor 60 is not possible, the movable blade 43 is not moved while the state of the roll paper 11 remains unclear. Therefore, a failure and the like of the movable blade 43 can be prevented.

Also, in the printer 100, the fixed blade 41 is disposed outside the cutter unit 45. When the movable blade 43, together with the fixed blade 41 outside of the cutter unit 45, cuts the roll paper 11, the cut roll paper 11 can be detected by the pickup sensor 60.

The printer 100 to which a method of controlling the printing apparatus according to the present disclosure is applied transports the roll paper 11 in a direction in which the roll paper 11 is discharged from the printer main body 13, and cuts the roll paper 11 by the fixed blade 41 and the movable blade 43 supported by the main body 45*b* of the cutter unit 45. The roll paper 11 is detected by the pickup sensor 60 supported on the main body 45*b* and the printer 100 determines that the error occurs when the roll paper 11 is not detected by the pickup sensor 60.

As a result, in the printer 100 configured to adjust a cutting position where the movable blade 43 cuts the roll paper 11 by moving the cutter unit 45, the presence or absence of the roll paper 11 can be more accurately detected by the pickup sensor 60, and paper clogging can be properly detected.

7. Other Embodiments

Note that the above embodiment describes a specific example in which the present disclosure is applied, and the present disclosure is not limited thereto.

For example, the printer 100 described in the above embodiment is described as a thermal printer for performing printing on the roll paper 11, but the present disclosure is not limited to this configuration. The present disclosure can also be applied to an ink jet-type printer in which ink is discharged onto a printing medium to print a character or an image, or to a dot impact-type printer for forming dots on a printing medium using a wire. Furthermore, the present disclosure can also be applied to other types of printing apparatuses and printing units incorporated into devices such as a composite machine. The printing medium is not limited to paper, and may be a cloth, nonwoven fabric, or other sheets. Furthermore, a shape of the printing medium is not limited to roll paper, and may be a configuration in which a cut sheet having a predetermined size is used. The present disclosure is more effective if being applied to a so-called line printer in which printing is performed in each line.

In the above embodiment, the configuration is that the power of the cutter motor 52 is transmitted to the movable blade 43 by the transmission mechanism 56, the worm gear 51, the worm wheel 53, and the crank pin 55 accommodated in the cutter unit 45 so that the movable blade 43 is moved. Details of the drive mechanism of the movable blade 43 are not limited to the above embodiment. For example, a configuration may also be that an output shaft of the cutter motor 52 and the movable blade 43 are coupled via a gear. Alternatively, instead of the cutter motor 52, an actuator may be arranged on the cutter unit 45, the movable blade 43 may be moved by a drive force of the actuator, or the movable blade 43 may be moved by another power source.

Furthermore, each of the functional units illustrated in FIG. 12 may not include independent hardware, and it is needless to say that software and hardware can be worked together to aggregate functions of the plurality of functional units into a single piece of hardware to realize the functions. A program to be executed by the CPU 181 performing the above-described operations may be stored not only in the ROM 182 provided in the printer 100 but also in other storage devices, storage media, and storage media for external equipment.

What is claimed is:

1. A printing apparatus for cutting, by a first blade and a second blade, a printing medium drawn from a roll paper, the printing apparatus comprising:

a printing apparatus main body;

a detector configured to detect the printing medium;

a cutter support configured to support the first blade and the detector, and wherein an attachment position of the cutter support to the printing apparatus main body is changeable, and with a change of the attachment position of the cutter support, an amount of a remaining portion of the printing medium after being cut by the first blade, changes.

2. The printing apparatus according to claim 1, comprising a transport unit configured to transport the printing medium, wherein the detector is provided downstream, in a transport direction of the printing medium, of the first blade.

3. The printing apparatus according to claim 2, comprising:

a drive mechanism configured to drive the first blade; and a protective cover configured to cover at least a part of the detector, wherein the movable blade, the drive mechanism, the detector, and the protective cover are provided inside the cutter support.

4. The printing apparatus according to claim 3, comprising a control unit, wherein the control unit is configured to:

perform control to drive the first blade by the drive mechanism to cut the printing medium;

perform control, after the cutting, to transport the printing medium by the transport unit; and determine, after the transporting, an error when the detector fails to detect the printing medium.

5. The printing apparatus according to claim 1, wherein the printing apparatus main body comprises:

an accommodation unit configured to accommodate the roll paper; and a lid configured to cover the accommodation unit, wherein the second blade is provided at the lid.

6. The printing apparatus according to claim 1, wherein an operation of moving the first blade is not executed when breakage of a feeder line coupled to the detector is detected.

7. A method of controlling a printing apparatus including a printing apparatus main body and a cutter support attached to the printing apparatus main body, the method comprising:

transporting a printing medium in a direction of discharging the printing medium from the printing apparatus main body;

cutting the printing medium with a first blade and a second blade, wherein the first blade is supported on the cutter support and an attachment position of the cutter support to the printing apparatus main body is changeable;

detecting the printing medium by a detector supported on the cutter support; and determining an error when the detector fails to detect the printing medium.

* * * * *